US005121518A

United States Patent [19]

Muller

[11] Patent Number: 5,121,518

[45] Date of Patent: Jun. 16, 1992

[54] CABLE-STAYED BRIDGE AND CONSTRUCTION PROCESS

[76] Inyentor: Jean Muller, 13 rue Victor Hugo, 92150 Suresnes, France

[21] Appl. No.: 432,748

[22] PCT Filed: Feb. 5, 1989

[86] PCT No.: PCT/FR89/00040

§ 371 Date: Dec. 10, 1990

§ 102(e) Date: Dec. 10, 1990

[87] PCT Pub. No.: WO89/07173

PCT Pub. Date: Aug. 10, 1989

[30] Foreign Application Priority Data

Feb. 5, 1988 [FR] France ..... 88 01342

[51] Int. Cl.[5] ..... E01D 11/00; E01D 17/00

[52] U.S. Cl. ..... 14/21; 14/22; 14/18

[58] Field of Search ..... 14/18-22

[56] References Cited

U.S. PATENT DOCUMENTS

| | | | |
|---|---|---|---|
| 691,982 | 1/1902 | Sturgis | 14/18 |
| 2,960,704 | 11/1960 | Stoltenberg | 14/18 |
| 3,132,363 | 5/1964 | Roberts | 14/18 |
| 3,673,624 | 7/1972 | Finsterwalder | 14/19 |
| 4,451,950 | 6/1984 | Richardson | 14/18 |
| 4,625,354 | 12/1986 | Richard | 14/18 X |
| 4,742,591 | 5/1988 | Muller | 14/18 X |

FOREIGN PATENT DOCUMENTS

| | | | |
|---|---|---|---|
| 0057052 | 8/1982 | European Pat. Off. | 14/18 |
| 1235973 | 3/1967 | Fed. Rep. of Germany | 14/18 |
| 1409056 | 10/1968 | Fed. Rep. of Germany | 14/18 |
| 2111558 | 6/1972 | France | 14/18 |
| 7224784 | 2/1973 | France | 14/18 |
| 2109040 | 5/1983 | United Kingdom | 14/18 |

OTHER PUBLICATIONS

Beton-und Stahlbetonbau, vol 75, No. 2, pp. 29-36 FIG. 4-6 Feb. 1980 (Berlin, DE), F. Leonhardt et al: "Die Spannbeton-Schrägkabelbrücke . . . ".

Civil Engineering, vol. 56, No. 11 Nov. 1986 "Sunshine Skyway nears completion" pp. 32-35.

Beton-und Stahlbetonbau, vol. 75 No. 4 Apr. 1980 "Die Spahnbeton-Schrägkabebrücke uber den Columbia river . . . " pp. 90-94.

*Primary Examiner*—Ramon S. Britts
*Assistant Examiner*—Nancy P. Connolly
*Attorney, Agent, or Firm*—Breiner & Breiner

[57] ABSTRACT

A cable-stayed bridge including at least one concrete platform consisting of an assembly of caisson elements, at least partly prefabricated, extending transversely to the bridge. Each element is composed of an upper table and a lower table separated by spaces which extend transversely to the platform, and are connected by walls at the side and the end, and with longitudinal intermediate partitions and transverse partitions. The piers of the bridge extend preferably upwards to the platform and carry both a part of the platform and the pylon.

16 Claims, 15 Drawing Sheets 24
3
23
22

16
21
20
22
25
4a
24
3
23
4a
27
26
27

CABLE-STAYED BRIDGE AND CONSTRUCTION PROCESS

The present invention relates to guyed bridges with a concrete deck, which are intended especially for spanning distances of the order of 80 to 250 m, and to the construction of such bridges.

According to the present state of the art, the deck of such guyed bridges consists of a concrete caisson suspended at regular intervals by guys which themselves transmit the load to masts located on either side of the gap to be bridged.

The guys can be arranged in the mid-plane of the structure between the traffic lanes. The stability of the deck under the influence of the asymmetric loads when a single traffic land is loaded is thus ensured by the torsional resistance of the caisson.

In another known form, the guys are placed on either side of the deck in two vertical or oblique planes also inclined on either side of the axis of the structure, to allow the guys to converge at a single point on the head of the mast.

As regards this double lateral suspension, recent embodiments for simplifying the construction of the deck and reducing its cost have appeared. When the main span is sufficiently small (of the order of a maximum of 100 to 150 m), the deck then consists of a simple solid concrete slab suspended along its two lateral edges. Limits are placed on the use of this solution by the excessive flexibility of the deck in terms of the risk of general buckling or for the practical operation of the structure. Furthermore, the low transverse rigidity of the slab does not always satisfactorily ensure the stability of the structure relative to the wind.

For longer spans (for example, from 100 to 300 m), the deck has consisted of a slab ribbed in the transverse direction and equipped with longitudinal edge girders in which the guys are anchored.

In principle, such decks are easier to produce than caisson decks. However, they do not have the same longitudinal bending rigidity, and above all their torsional inertia is negligible. The effects of accidental phenomena, such as exceptional gusts of wind or the impact of a vehicle against a guy, therefore have much more serious consequences on these structures.

On the other hand, the decks, whether in the form of caissons or formed from a ribbed slab, can be made of successive prefabricated elements assembled to one another in the longitudinal direction. This less costly method of construction does not have an appreciable effect on the rigidity, and the comments made above remain applicable here.

The object of the present invention is to overcome the limitations or inadequacies mentioned above, making it possible to produce structures of a rigidity comparable to that of caisson decks, whilst at the same time preserving the simplicity of form and construction of the decks in the form of a solid or ribbed slab.

To achieve this result, the invention provides a guyed bridge comprising:

at least one deck formed from a series of at least partially prefabricated elements, each element extending over the width of the deck and over some of its length, a mast which is carried by a pier and the top of which supports a series of guys supporting the deck and the particular feature of which is that each element has transversely elongate inner recesses and a vertical cross-section approximately symmetrical relative to a horizontal plane.

Thus, the main difference from the structures of conventional decks is that the bridge consists of a series of connected transverse caissons and no longer of longitudinal caissons or simple or ribbed plane slabs. The result of this a very high torsional rigidity of the deck for an equal weight.

The elements are fixed together to form the deck by all conventional means, especially by means of longitudinal prestressing cables extending over several successive elements and/or over the entire length of the deck.

According to a first embodiment of the elements, each of these is an element prefabricated in one piece and formed from a lower apron and an upper apron carrying the roadway, which are separated by inner voids extending over a large part of the transverse dimension of the element, the two aprons being connected to one another by means of longitudinal and transverse walls and, if appropriate, partitions.

According to another embodiment of the elements, each of these comprises a prefabricated part consisting of a lower apron and transverse and longitudinal vertical walls or partitions, horizontal slabs resting on the said walls or partitions, and an upper rough casting which is continuous along the deck, is poured on to the slabs and carries the roadway.

The first embodiment affords savings of time and productivity as a result of more comprehensive prefabrication. The second embodiment makes it possible to replace the roadway rough casting easily, if required, this being advantageous especially in countries with an extreme climate, where it is subjected to attack by deicing products.

Because of the high torsional rigidity of the deck, the corresponding forces are transmitted to a distance, particularly to the abutments and piers. It is advantageous to give the piers a structure making them capable of absorbing these forces. For this purpose, the pier carrying the mast can extend upwards as far as the deck and at the same time support at least part of the deck and the mast.

If the bridge has a relatively wide deck or two decks placed next to one another, advantageously each pier carries that part of the deck or decks which is nearest the longitudinal axial plane of the bridge and that part of the decks which is furthest away from the longitudinal axial plane of the bridge is supported by additional guys arranged approximately in a transverse vertical plane and connecting the deck to the top zone of the mast.

A triangular structure consisting of the deck, the mast and the additional guy is thus produced. This structure is formed in a transverse plane and is therefore perpendicular to the longitudinal triangles formed by the deck, the mast and the conventional guys.

According to an expedient embodiment, at least one of the said additional guys is deflected at the top of the mast and is fastened to the opposite edge of the deck. The fixing and tensioning of the additional guys are thus carried out at deck level, thereby making assembly easier.

According to a different embodiment especially useful for a bridge of great length with two decks, these are articulated on one another or are connected rigidly to one another in line with the pier, and at least one of the said additional guys is deflected at the top of the mast and is fastened to the opposite edge of the same deck in the vicinity of the longitudinal axial plane of the bridge.

To reinforce the connection between the deck and the girder even further, there can be, preferably besides the additional guys, oblique bracing girders which connect the edge of the deck furthest away from the pier to a point of the latter located lower than the deck.

The arrangements just listed are compatible with various types of bridge guying, especially those where there is a single sheet of guys in the longitudinal axial plane of the bridge, those where there are two sheets of guys, each arranged in an oblique plane containing the outer edge of a deck and the top of the mast, or those where there are four sheets of guys, two arranged in the oblique planes just mentioned and two others in almost vertical planes connecting the top of the mast to those parts of the decks located in the vicinity of the longitudinal axial plane of the bridge.

The head of the mast is of a complexity increasing with the number of sheets of cables, especially if it has to support the additional cables mentioned above, which are in planes perpendicular to these sheets.

According to a first embodiment, the head of the mast is a metal piece which has a saddle-shaped surface in its upper part and on which the deck-supporting guys resting side by side are deflected so as to go to two fastening points located on the deck approximately symmetrically relative to the mast, the middle part of the said metal piece having a cavity which contains the means for the anchorage of deflection of the additional guys.

According to a second embodiment, the head of the mast possesses, for each sheet of cables, a deflecting assembly arranged in the plane of this sheet and comprising at least one piece through which passes a number of deflecting passages equal to the number of guys, these passages being superposed on one another, and the means for the anchorage or deflection of the additional guys being placed between the deflecting assemblies.

This embodiment is of more complicated construction, but it proves especially suitable for bridges with four sheets of guys, since it results in a head of small transverse dimensions with low cantilever stresses on the mast. Furthermore, all the guys of the same sheet are exactly in the same plane.

It should be noted that the two head structure are of interest even when there are no additional guys.

Another point to be considered is the fastening of the guys to the elements forming the deck. This fastening normally has to be carried out through a lateral wall of the prefabricated element. The fact that the guys have different inclinations from one another means that, if, as is customary in practice, there is a passage through the element with a fastening device on the lower face, the prefabricated elements carrying the fastenings will be different from one another, and in particular their reinforcing bars will have to be arranged differently. This is likely to complicate the work of the prefabrication yard and reduce its efficiency.

To avoid this disadvantage, the means for fixing a guy to an element of the deck advantageously comprise a plate which is plane as a whole and which bears against the deck by means of a first face and on the second face carries means for anchoring the guy, means for preventing the said plate from sliding on the deck, and at least one prestressing cable or anchoring rod directed approximately perpendicularly relative to the plane of the said plate, this cable passing through the said plane, being retained by butting against it and passing through the deck so as to bear against the opposite side of the deck.

According to a first embodiment, the deck has a plane bearing surface for the plate, this plane surface being parallel to the guy and to the longitudinal axis of the bridge, with a central hollow part, the plate carries, on its face in contact with the said bearing surface, a projection which penetrates into the said hollow part and which contains the means for fastening the said prestressing cable, and the prestressing cable penetrates into the deck at the bottom of the said hollow part and is fastened to the transversely opposite edge of the deck.

It will be appreciated that, according to this embodiment, the edges of the prefabricated elements all have parallel bearing surfaces and form with the vertical the same angle as the corresponding sheet of cables. The prefabricated elements can therefore all be identical, the orientation of the metal anchoring piece being the only difference from one prefabricated element to another, if this piece is installed during casting. These pieces can also be installed during the assembly of the bridge. The plate or at least the projection on its face turned towards the deck will then be given a form of revolution, for example frustoconical.

According to another advantageous embodiment, especially for a bridge with two decks very close to one another, the plate is intended to bear on a horizontal surface of the deck and, on the face opposite the deck, carries mountings for fastening a guy obliquely relative to the horizontal, and the prestressing cable or cables or anchoring rods pass downwards through the deck.

This embodiment makes it possible to save space in a transverse direction, and it makes assembly, checking and possible replacements easier. In contrast, the metal fastening pieces must be made individually, unless a pivot system is employed.

The bridge structure according to the invention makes it possible to carry out an especially advantageous construction process. According to this process, a temporary framework fastened to a deck part already constructed and supported by the guys is put in place, this framework advancing in cantilever fashion beyond the said part already constructed and being supported by an assembly cable connecting the top of the mast to that end of the temporary framework furthest away from the part already constructed, and the said temporary framework is used for installing and securing new deck elements, the length of the assembly cable being changed when the temporary framework is shifted.

This avoids subjecting the bridge part already constructed to abnormal stresses.

The invention will now be described in more detail by means of practical examples illustrated in the figures of which:

Figures 4, 4A:
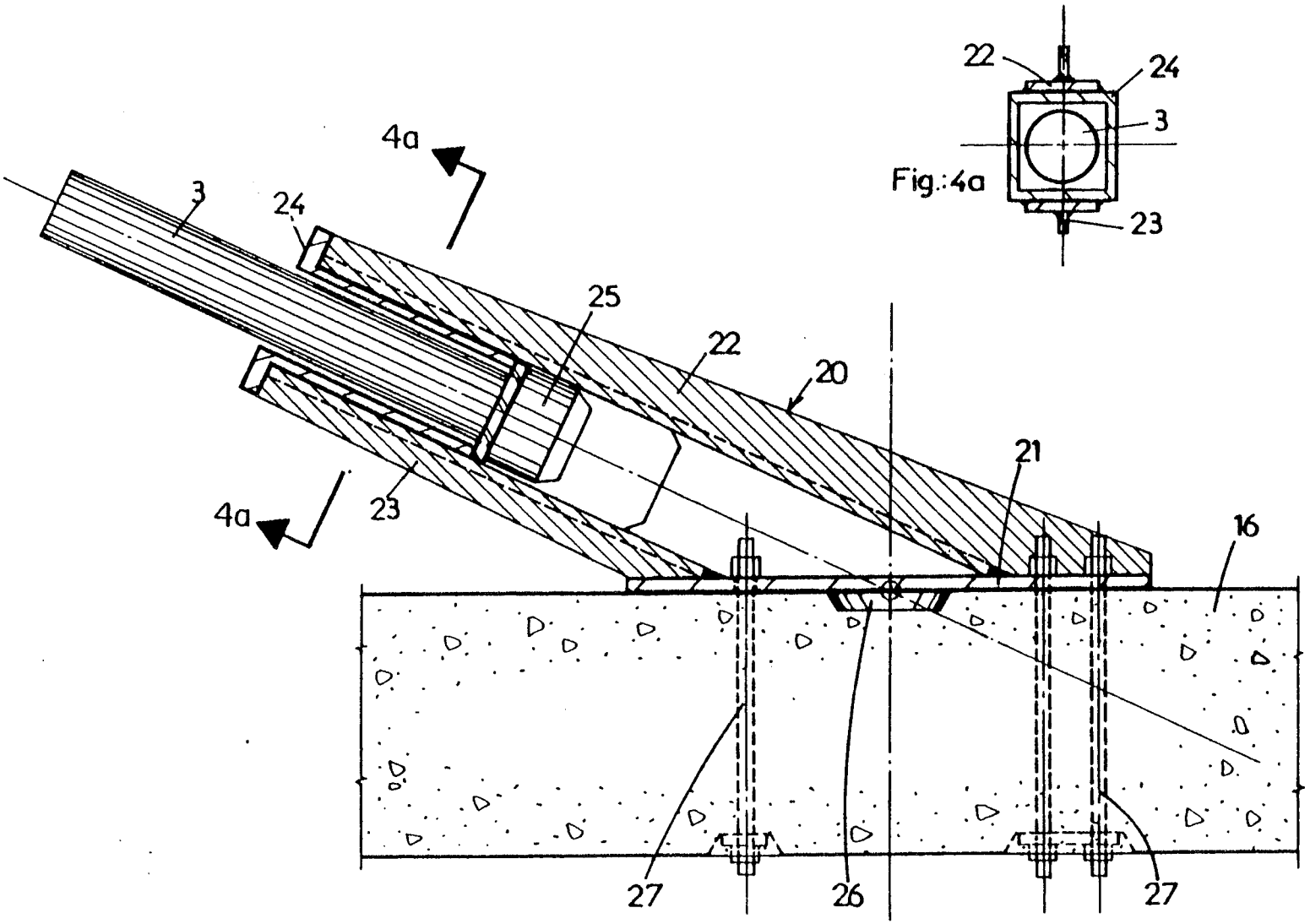
FIG. 4 is a longitudinal section through a device for fastening a guy to the deck.
FIG. 4*a* is a cross-section through the same device along the line AA of FIG. 4.
Figure 5:
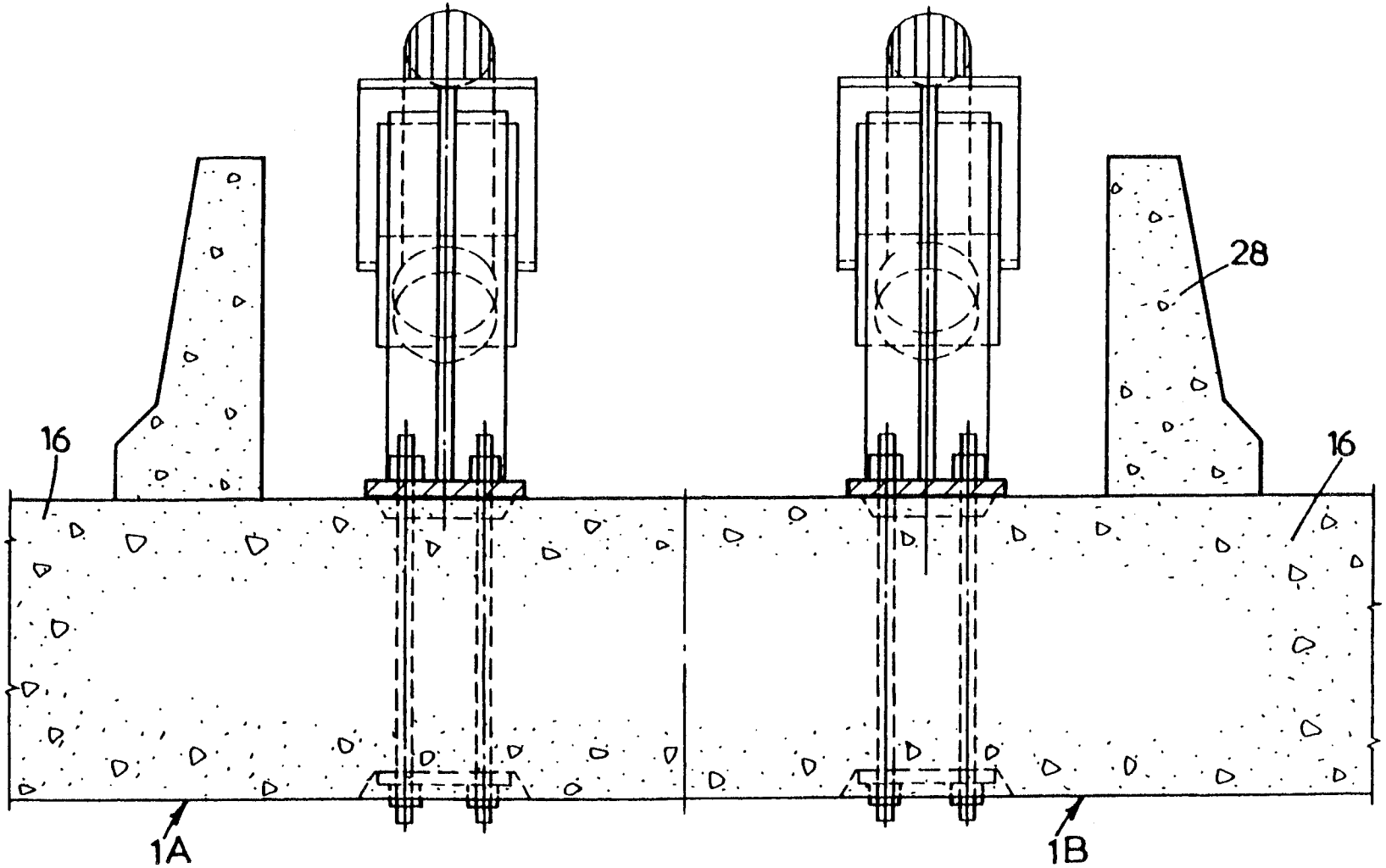
FIG. 5 is a cross-section through a deck, showing two fastening devices identical to those of FIG. 4.
Figure 10:
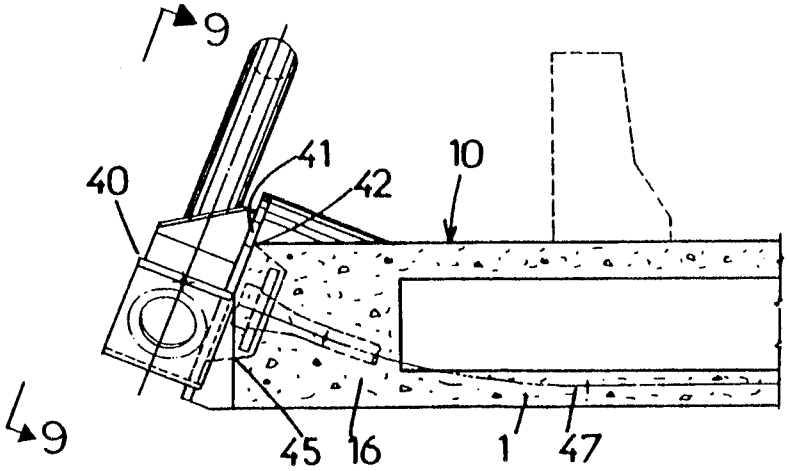
Figure 12:
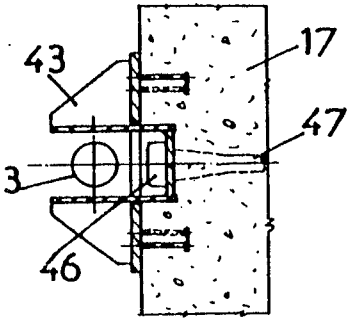
Figure 9:
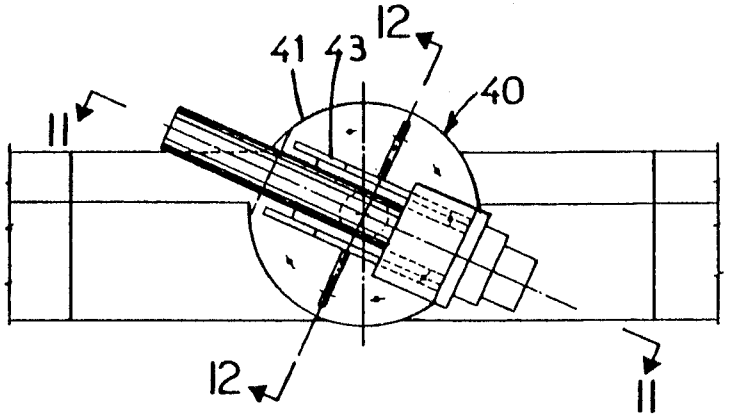
Figure 11:
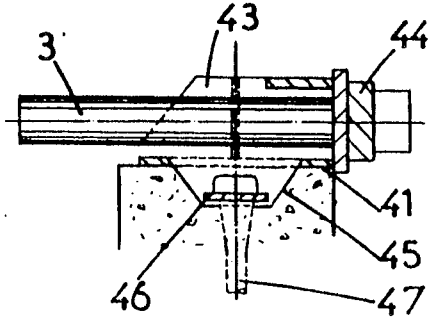

FIGS. 9 to 12 describe a guy-fastening device according to an embodiment different from that of FIGS. 4 and 5, FIG. 9 being an elevation view, FIG. 10 a cross-section, FIG. 11 a longitudinal section and FIG. 12 a section perpendicular to the direction of the guy.

Figure 13:
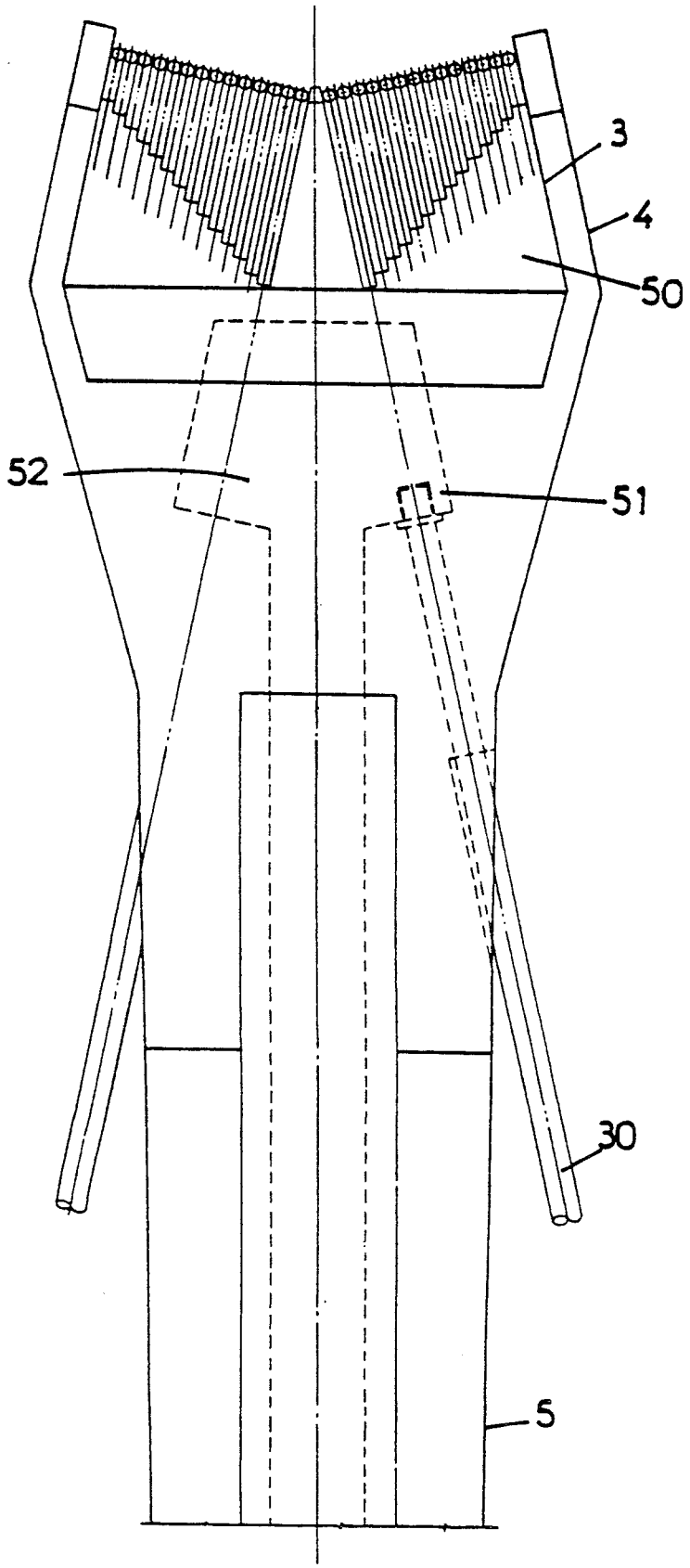

FIG. 13 is a side elevation view of the head of a mast.

Figure 14:
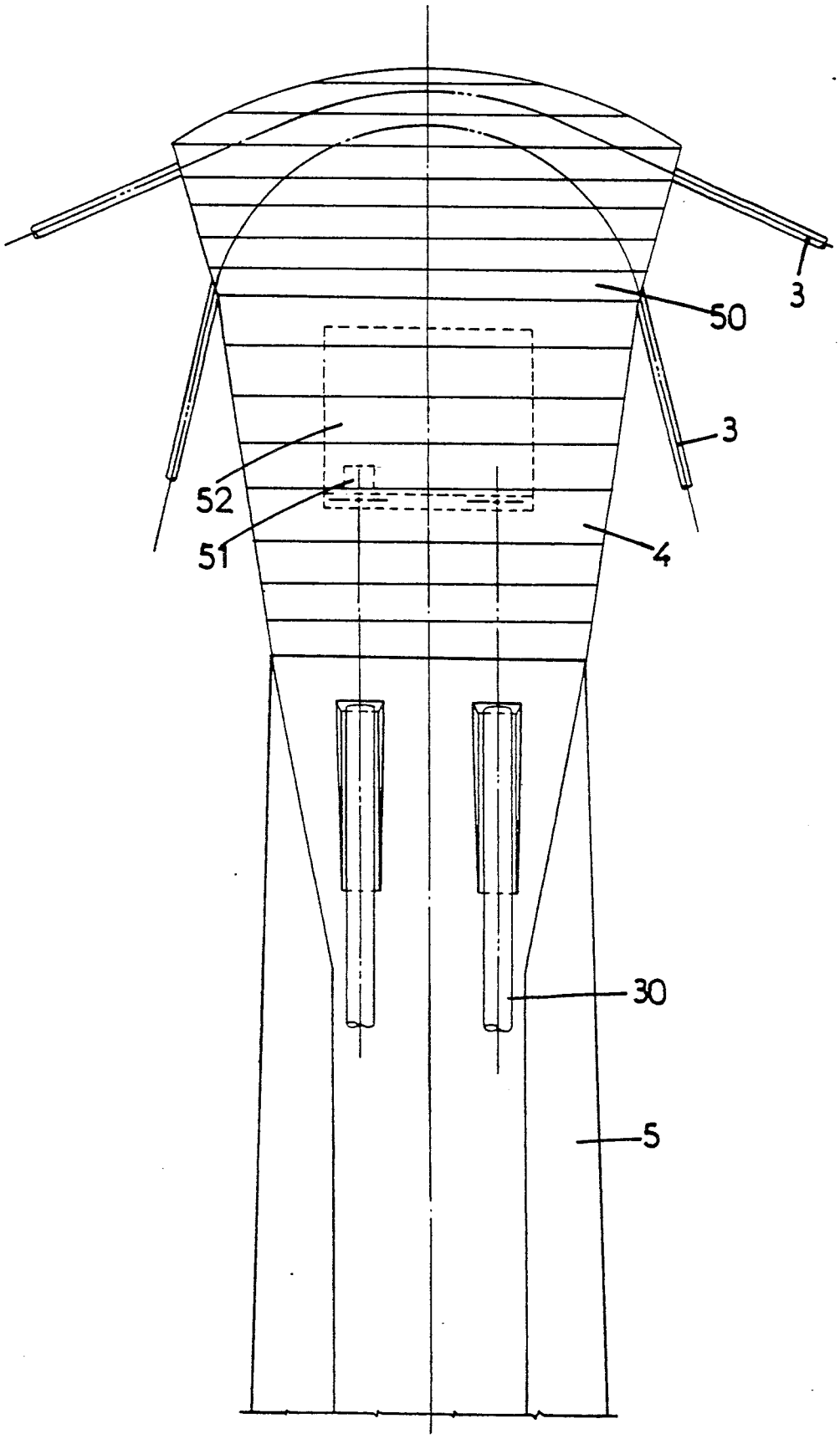

FIG. 14 is a longitudinal elevation view of the same head.

Figure 15A:
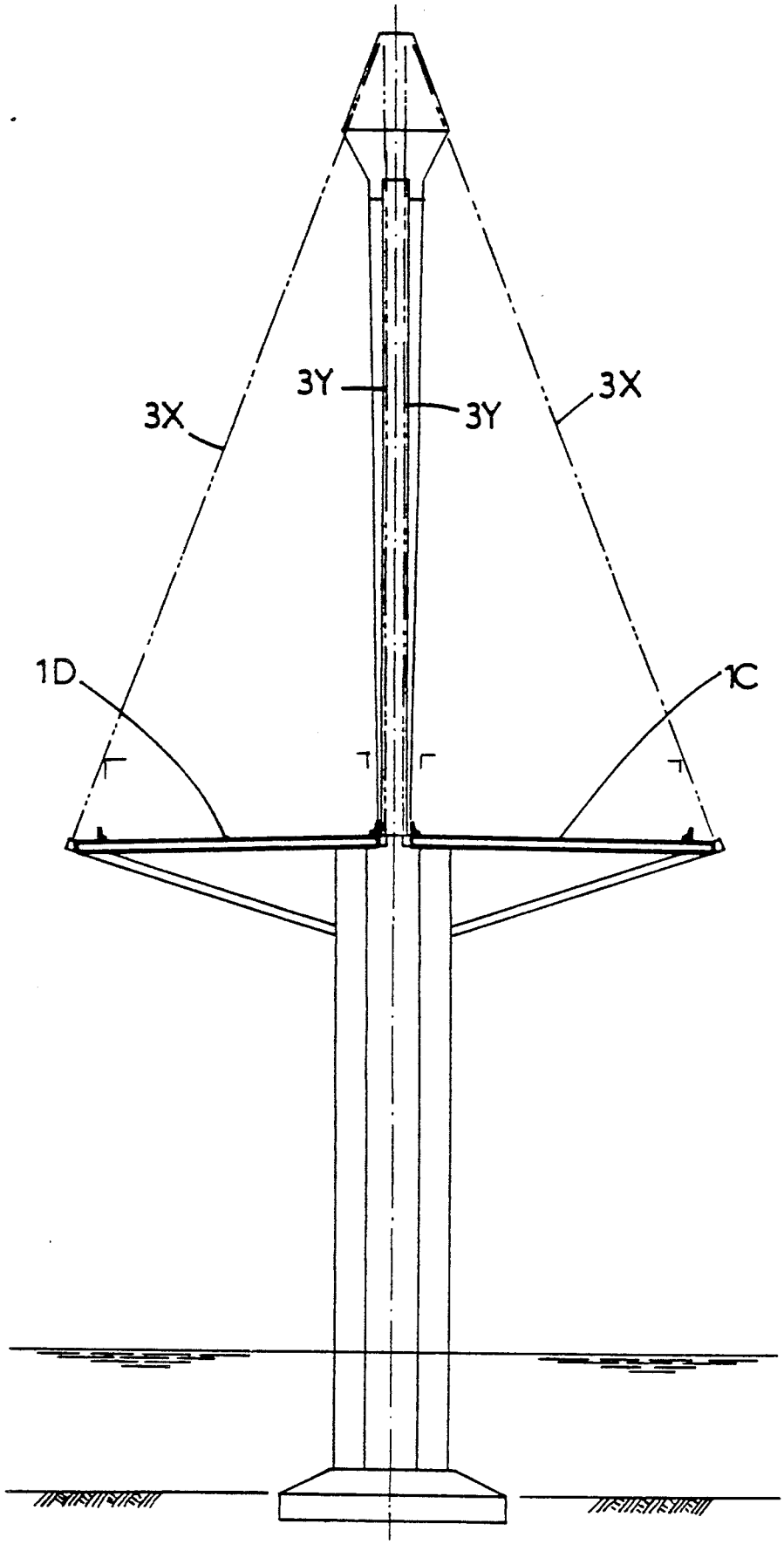
Figure 15B:
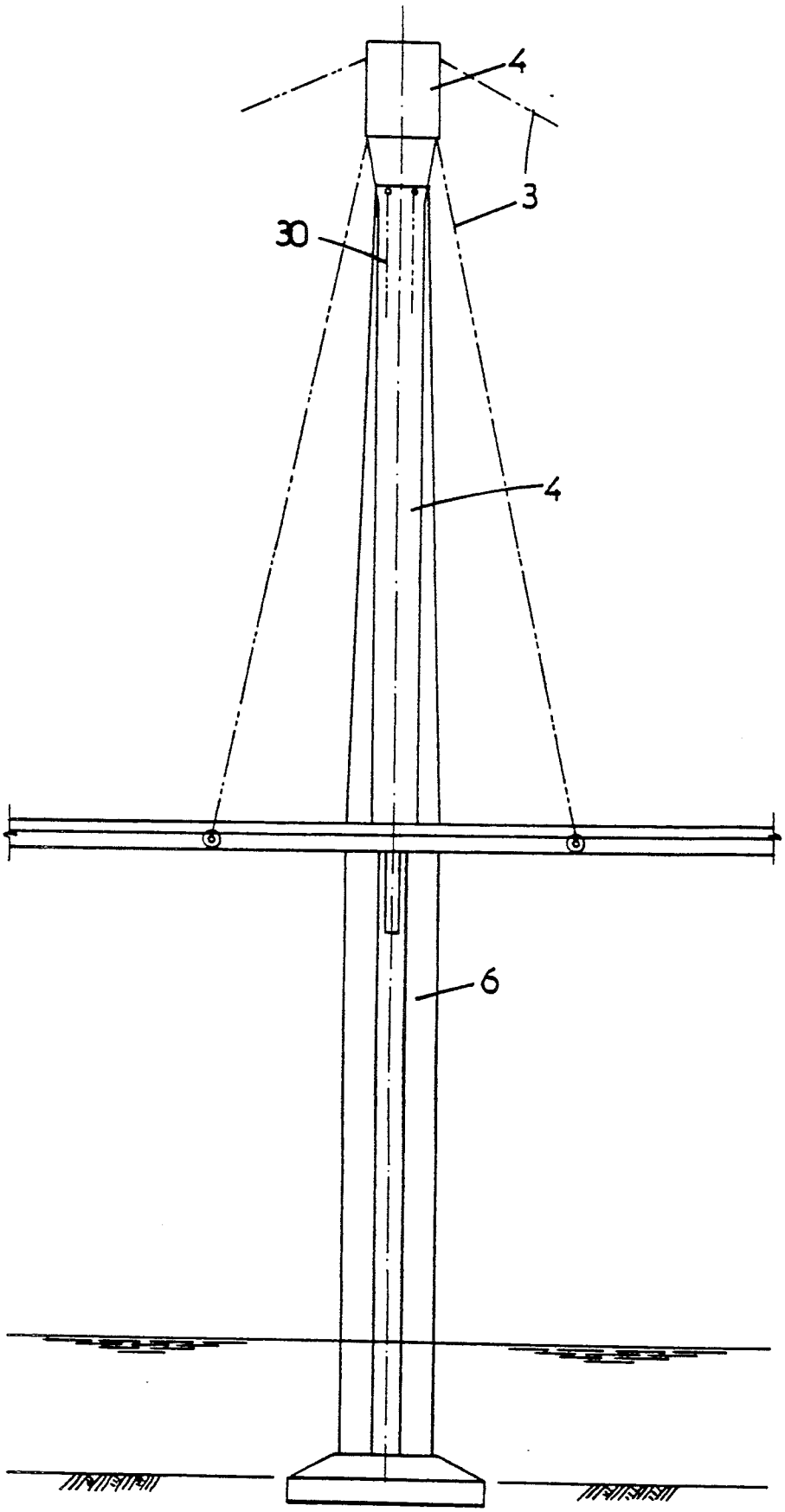

FIGS. 15*a* and 15*b* are respectively partial cross-sectional and elevation views of a third embodiment according to the invention.

Figure 16:
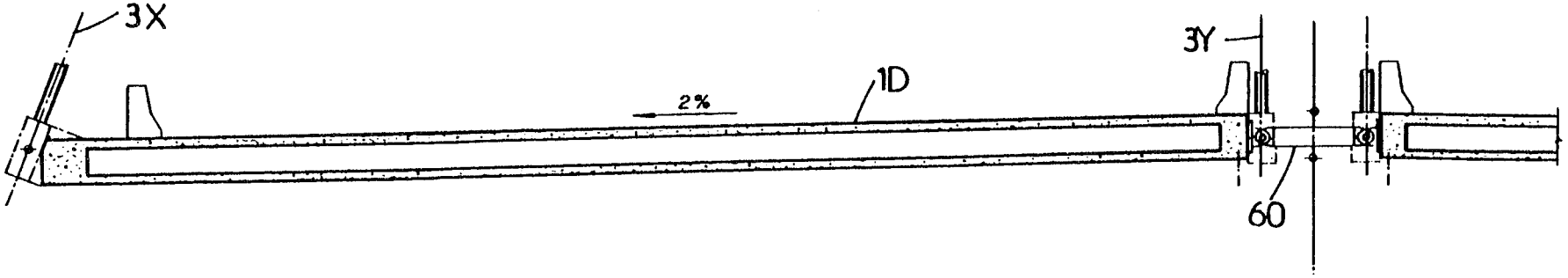

FIG. 16 is a partial cross-section through the decks of the bridge illustrated in FIGS. 15*a* and 15*b*.

Figure 17:
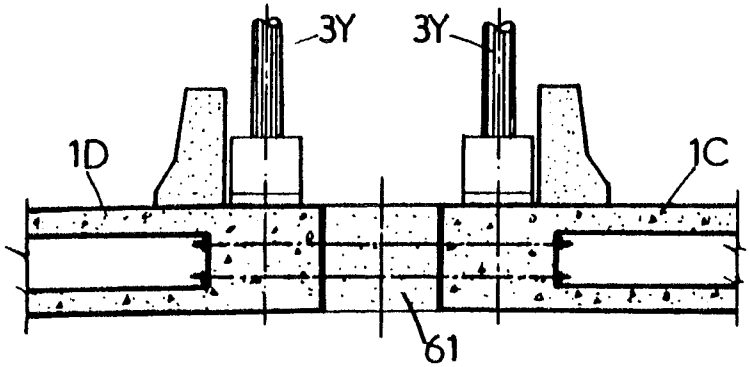

FIG. 17 shows an alternative version of the central zone of the decks of FIG. 16.

Figure 19:
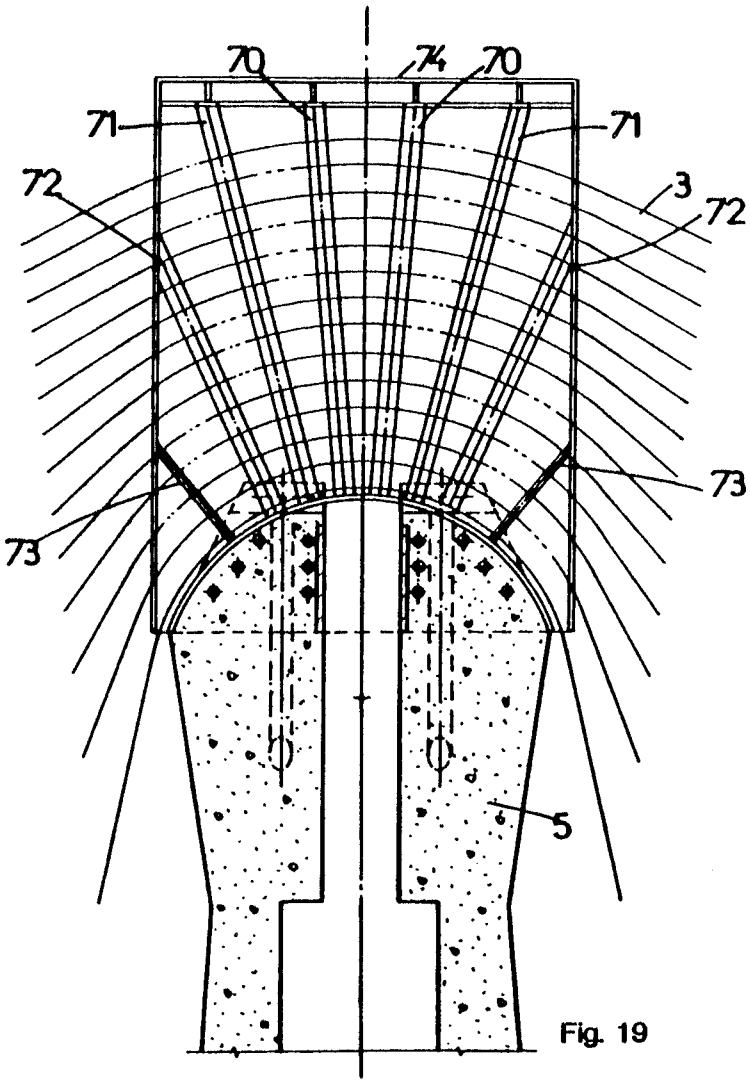
Figure 18:
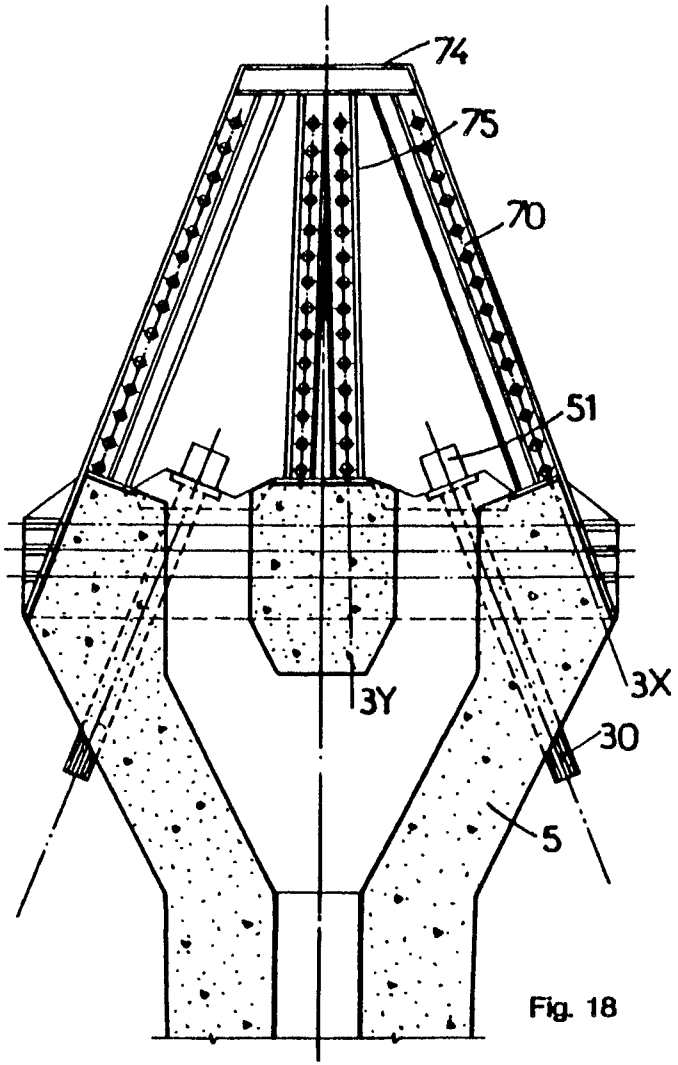

FIGS. 18 and 19 are respectively a cross-sectional view and a longitudinal elevation view of an embodiment of a mast head different from that of FIGS. 13 and 14.

Figure 20:
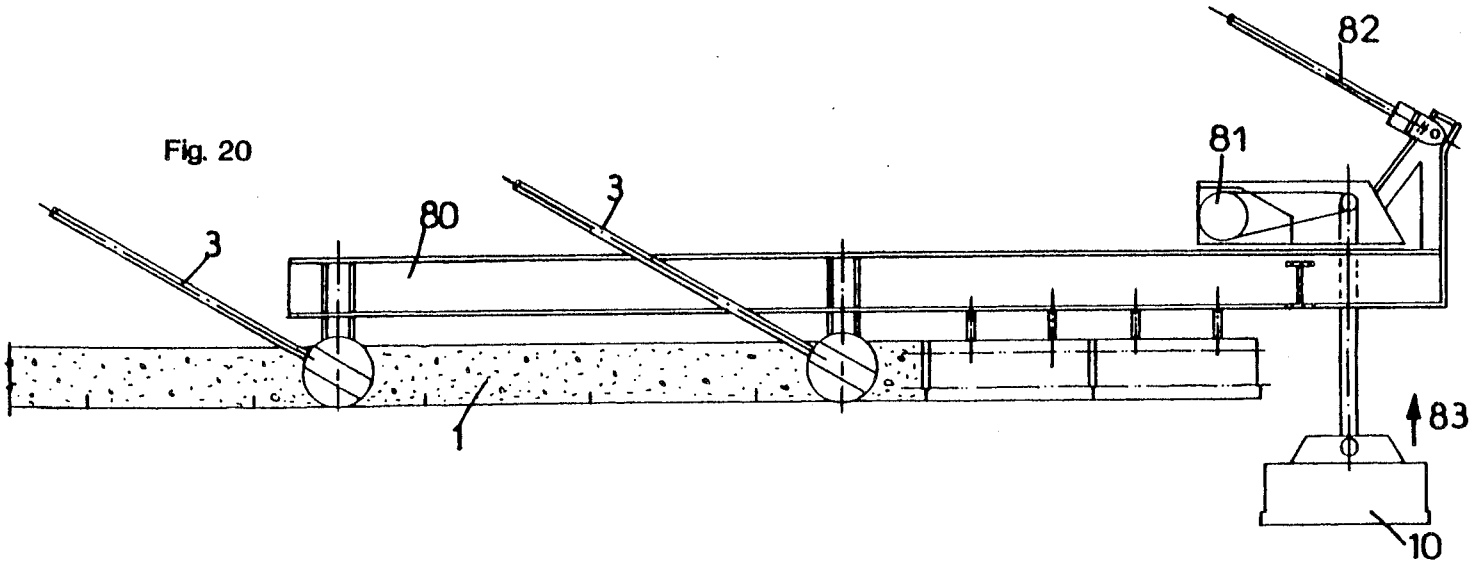
Figure 21:
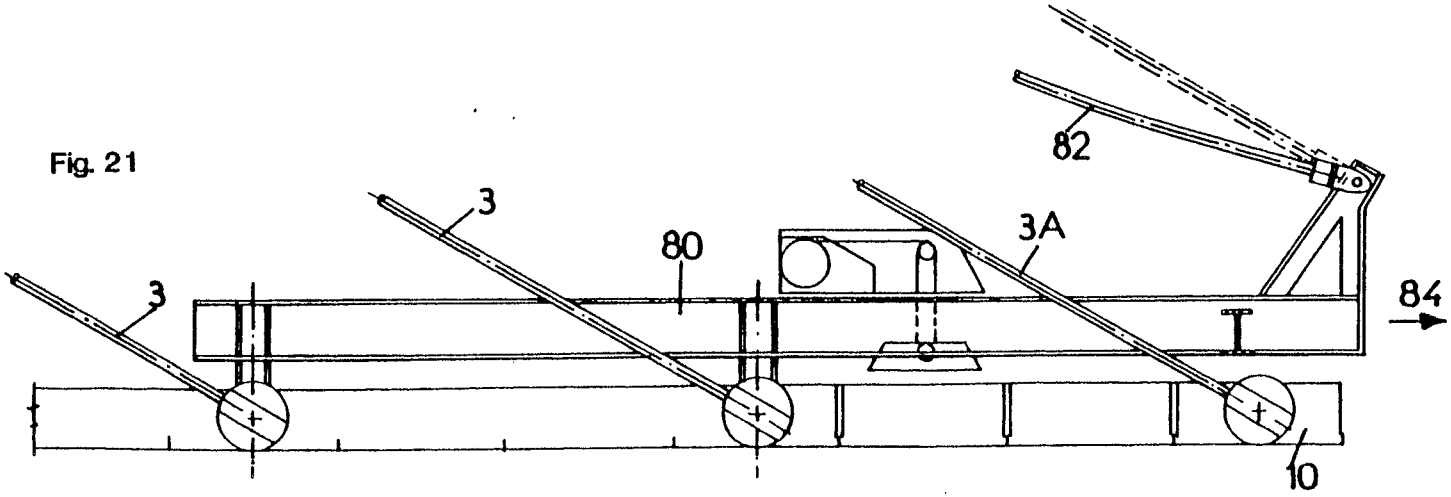

FIGS. 20 and 21 are diagrammatic views showing two successive phases of the process for constructing a bridge according to the invention.

Figure 1:
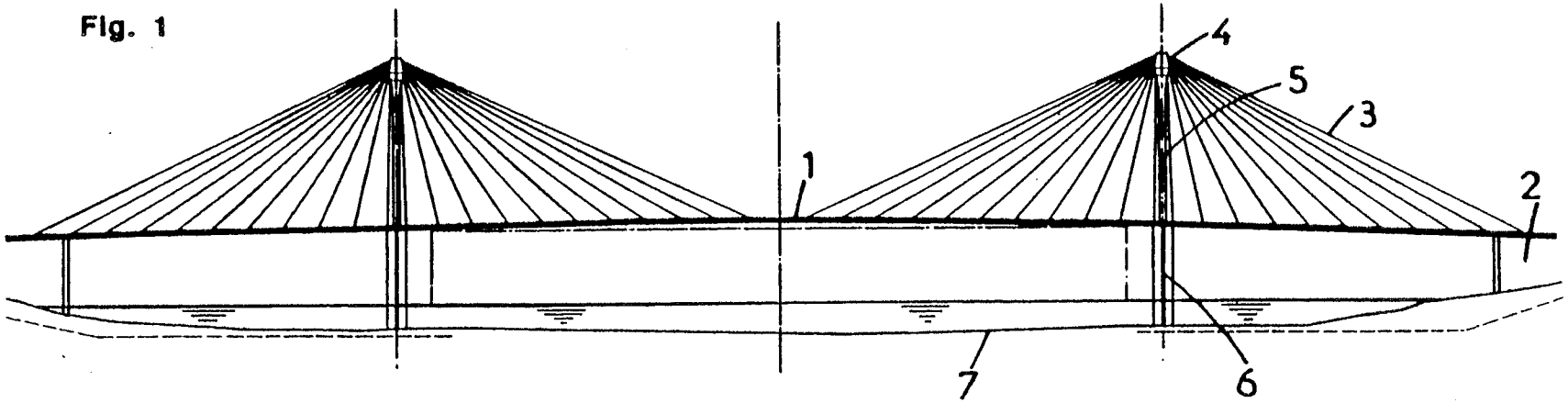
FIG. 1 is an elevation view of a guyed bridge.

FIG. 1 shows a guyed bridge comprising a deck 1 which at its end rests on end piers 2 and which is supported in its central part by guys 3 connecting it to the head 4 of two masts 5 carried by piers 6, themselves founded on the ground 7.

It is clear that the invention is not linked to the number of piers and masts.

Figure 2:
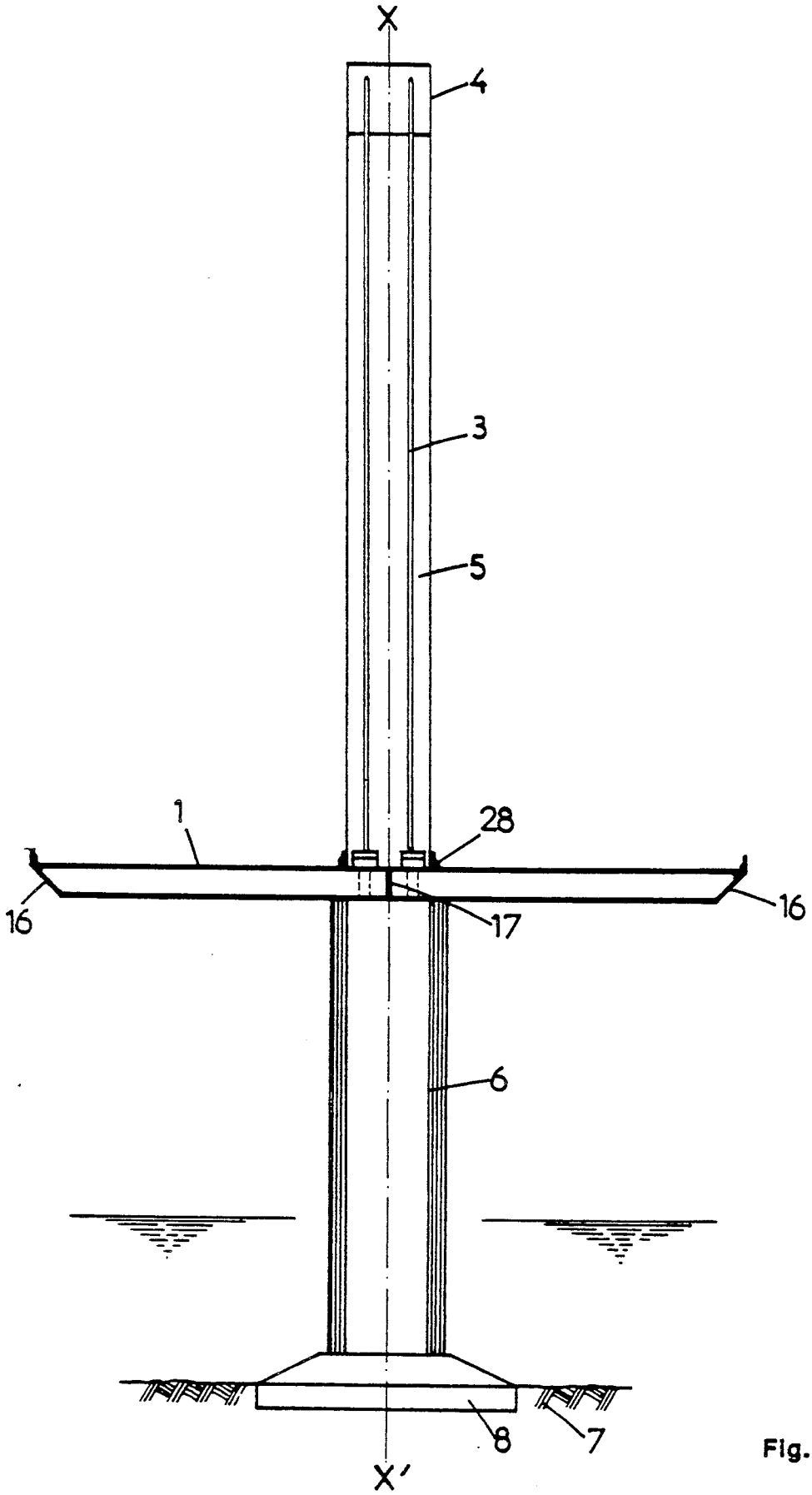
FIG. 2 is a cross-section through a structure according to FIG. 1 in its simplest embodiment.

FIG. 2 shows a cross-section through a bridge according to the invention, in its simplest embodiment: the bridge comprises a deck 1 arranged symmetrically relative to the transverse axial plane XX' of the structure. The deck is supported by two substantially vertical sheets of guys 3 which connect the head of the mast to the deck 1 in its region nearest the axial plane XX'. The pier 6 resting on the ground 7 by means of a sole 8 extends upwards to the level of the lower part of the deck which it supports. It also supports the mast 5 which has a transverse extension smaller than that of the pier 6.

The deck 1 is formed from a series of hollow transverse structures, this giving them high bending rigidity. The bending forces are supported essentially by the abutments and additionally by the piers 6 and the guys 3.

Figure 3:
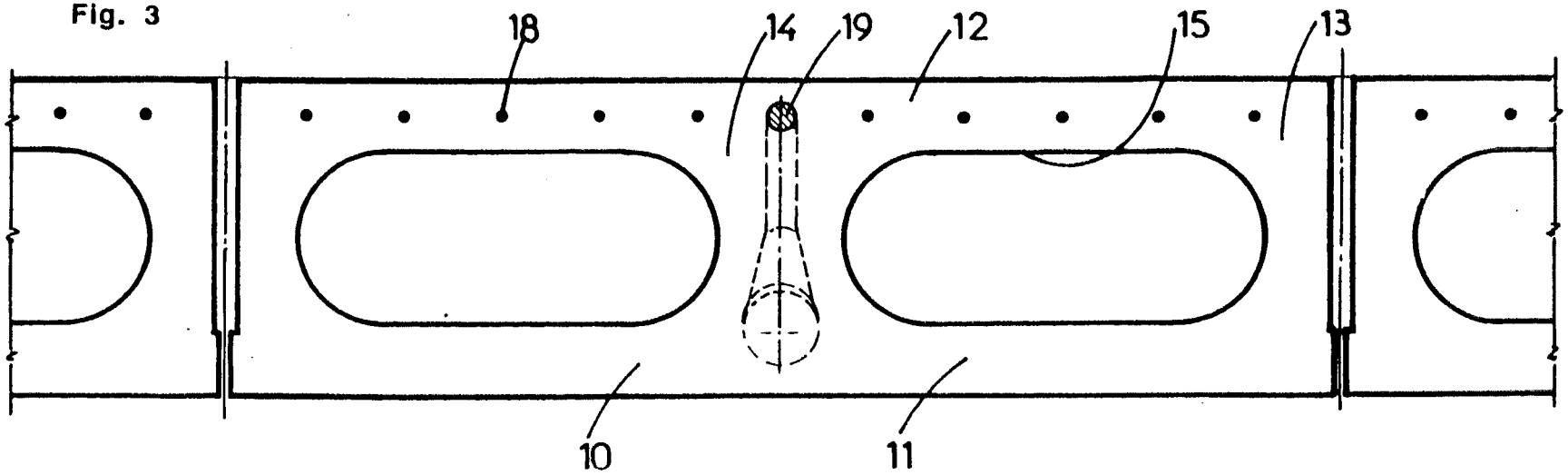
FIG. 3 is a partial longitudinal section through a bridge deck according to the invention.

FIG. 3 shows a longitudinal section through a deck element 10, the assembly of similar elements forming the deck 1. The element is a prefabricated element comprising a lower apron 11 and an upper apron 12, the latter supporting the roadway. The aprons 11 and 12 are connected by means of transverse walls 13 and by means of an intermediate partition 14. The number of intermediate partitions 14 is not fixed and can depend on the dimensions of the element 10. There can even be no intermediate partition 14. Between the walls 13 and the intermediate partition 14 can be seen voids 15 which serve for reducing the weight of the element and for improving the efficiency of its load-bearing section in terms of a longitudinal bending of the structure. It will be seen that the cross-section of the deck is symmetrical relative to a horizontal plane.

The voids 15 extend transversely as far as the edge walls 16 (FIG. 2), being interrupted only by a middle partition 17 which reinforces the rigidity of the element in the longitudinal direction. The transverse resistance of the element is ensured by reinforcements 18 which can be conventional passive reinforcements, pretensioned adherent prestressing reinforcements or post-tensioned prestressing reinforcements having a layout matched to the bending stresses, or any combination of the three types of reinforcement. FIG. 3 shows only a small number of these reinforcements. The deck elements 10 bear on one another and are held by longitudinal prestressing cables (not shown).

At the centre of FIG. 3, a transverse prestressing cable 19 can be seen.

FIGS. 4, 4*a* and 5 illustrate the method of connecting the guys 3 to the decks 1A and 1B of FIG. 2. A fastening piece 20 comprises a bearing plate 21 which, on its upper face, carries mountings 22, 23 welded to the said plate 21 and oriented obliquely in such a way that their web is parallel to the direction of the guy 3. The mountings 22, 23 retain the guy 3 by means of a stop piece 24 which interacts with a clamping head 25 of the guy. The plate 21, on its lower face, carries a frustoconical projection 26 which penetrates into a cavity of the same shape provided in the longitudinal wall 16 of a deck element 10.

Furthermore, anchoring ties 27 pass through the plate 21 and are put under prestress, at the same time bearing on the lower face of the deck. These ties are shown vertical, but can be oblique.

The forces transmitted to the deck by the guy 3 can be analysed as comprising a vertical component transmitted to the deck by means of the plate 21 and the ties 27 and a horizontal component which is transmitted to the deck by means of the plate 21 and the projection 26 functioning as an anchoring key.

FIG. 5 also shows barriers 28 which keep the vehicles away from the fastening devices. The spacing between these two barriers 28 determines the free space for the foot of the mast, as can be seen in FIG. 2.

Figure 6:
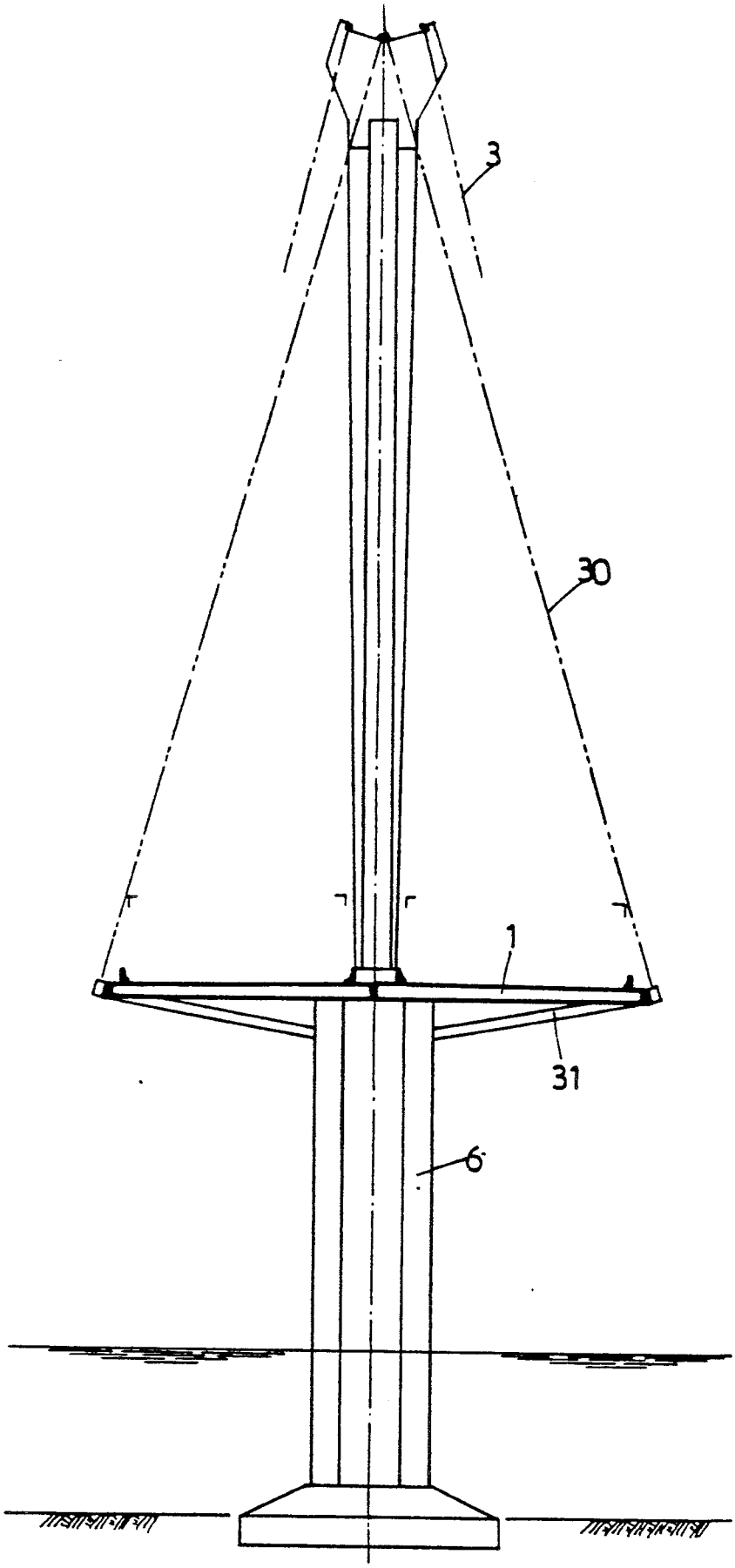
FIG. 6 is a cross-section, in line with the mast, of an embodiment different from that of FIG. 2.
Figure 7:
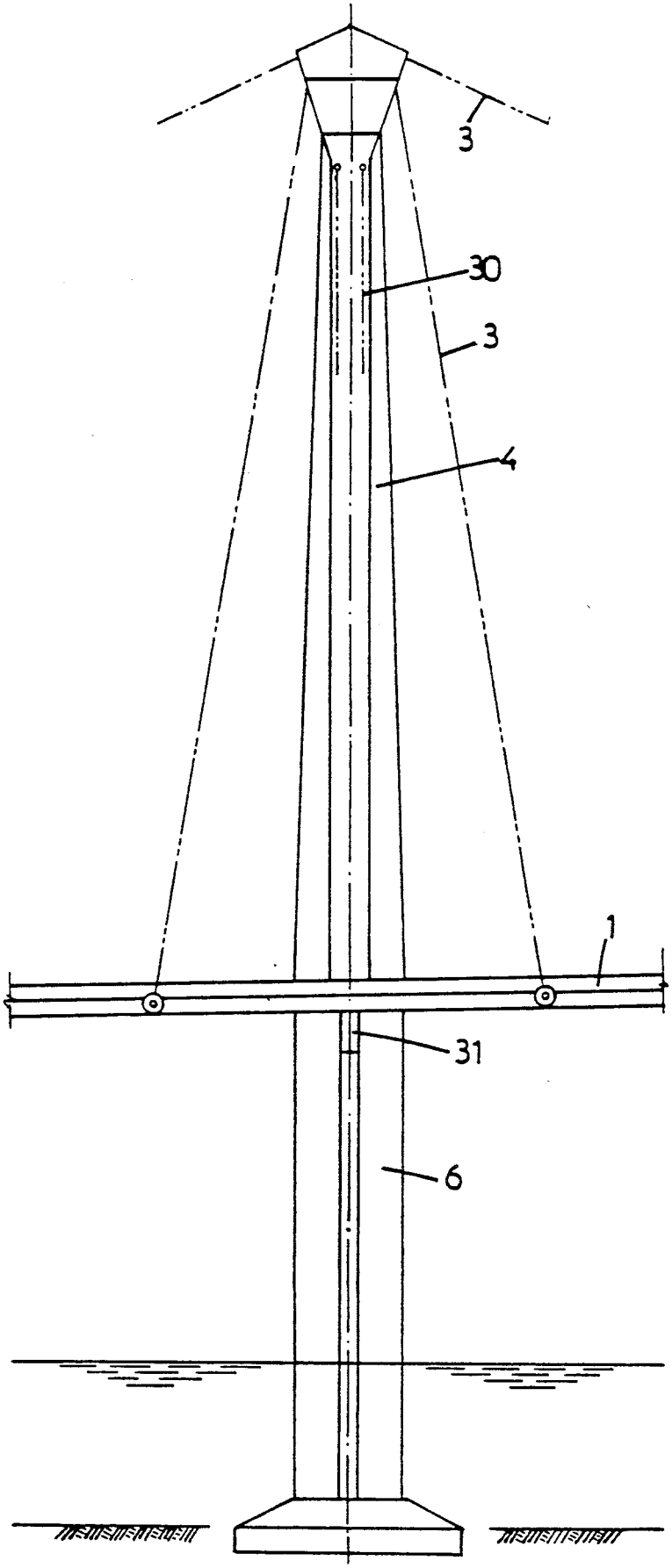
FIG. 7 is an elevation view of the bridge in the vicinity of the mast according to the embodiment of FIG. 6.

FIGS. 6 and 7 relate to another embodiment.

When there is an increase in the width of the deck (together with the number of traffic lanes to be carried) and in the main span between masts, both the torsional stresses in the deck and the transverse deformability under the passage of asymmetric loads (only one roadway loaded) become critical. According to the second embodiment, the deck is suspended by means of two sheets of guys 3 anchored to the edges and contained in two oblique planes which intersect substantially at the upper level of the mast 4.

The entire load of the deck 1 is transmitted to the pier 6 and to the foundations by means of the central mast 4, the forms of which are selected so as to have a maximum longitudinal inertia at deck level and a minimum transverse inertia at its top.

The guys 3 adjacent to the mast contribute to the resistance of the structure to horizontal forces. Special stabilizing guys 30 are also provided for this purpose in the transverse plane passing through the axis of the mast. Moreover, the deck is stiffened, as required, in this plane by means of stays or struts 31 connecting the edges of the deck to the pier 6.

Figure 8:
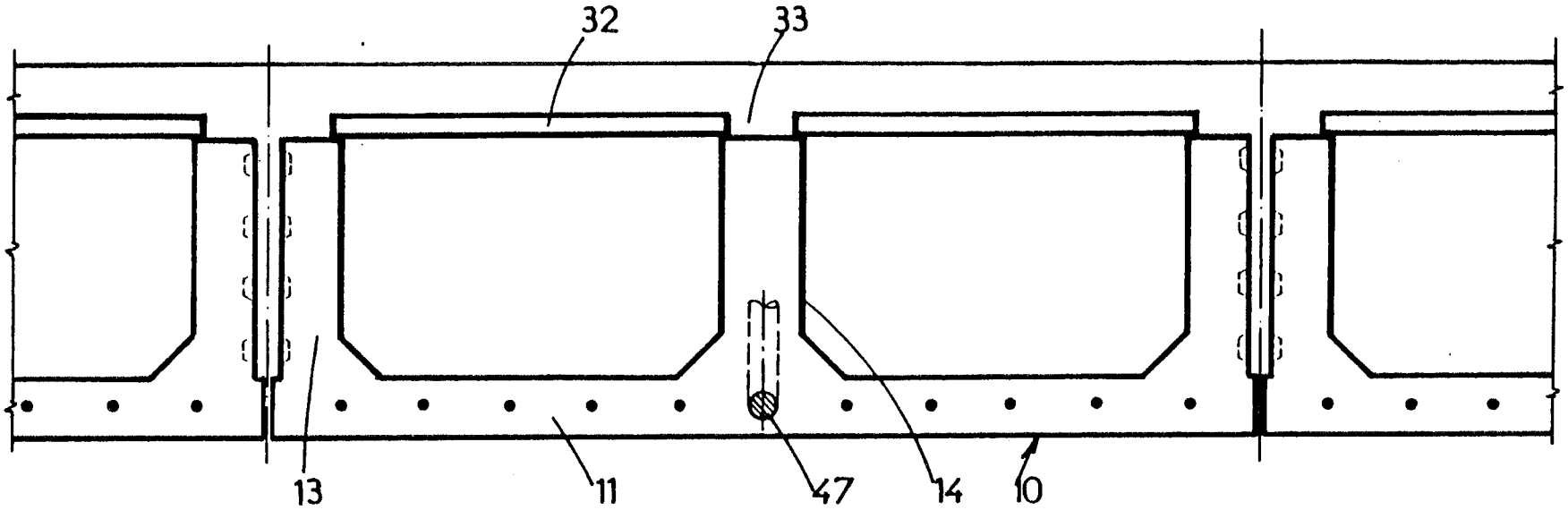
FIG. 8 is a partial longitudinal section through a deck according to an embodiment different from that of FIG. 3.

FIG. 8 is a longitudinal section showing an alternative version of FIG. 3.

The lower part of each deck element 10 consisting of the lower slab 18 and the walls or partitions 13 to 16 forming webs is prefabricated. After installation in the structure, pre-slabs 32 are put in position and the upper rough casting 33 carrying the roadway is poured in place.

The process makes it possible to ensure the structural continuity of the roadway roughcasting. In extreme climates, attack by de-icing produces may make it necessary to replace the roadway slab. The operation is then especially simple according to the arrangements just described. In contrast the symmetry relative to the horizontal mid-place is less strict than in FIG. 3.

FIGS. 9 to 12 relate to a device for anchoring the guys to the outer edges or margins of the deck. Devices similar to those described with reference to FIGS. 4 and 5 could be used for these anchorages, but the disadvantages of these is that they limit the width of the roadway. The device described in FIGS. 9 to 12 avoids this disadvantage, whilst at the same time conforming to a similar principle. An anchoring piece 40 comprises a plate 41 or general circular shape, which comes to bear on a circular surface 42 provided during the production of the deck elements 10. The surface 42 is oblique relative to the vertical and forms with this the same angle as the sheet of guys 3. The plate 41, on its outer face, carries mountings 43 arranged perpendicularly relative to the plate 41 and carrying the system 44 for the fastening and tensioning of the guy 3. The plate 41, on its lower face, carries a frustoconical projection 45 which penetrates into a corresponding cavity of the deck element. Seated in the projection 45 is the means 46 for fastening a prestressing cable 47 which can also be seen in FIG. 8. The cable 47, which bears on the outer longitudinal wall 16 forming the edge of the deck, passes through this, then penetrates into the lower slab 11 and, on the opposite side of the deck, is connected to another fastening piece 40 or to any means of bearing on the opposite edge of the element. It thus contributes not only to keeping the fastening piece 40 in place against the deck element 10, but also to the transverse rigidity of this element. It will be seen that it is oriented in the transverse direction horizontal over most of its path and relatively only slightly oblique at its ends. It can therefore easily be accommodated between the reinforcing bars of the element 10. The prefabricated elements 10 are identical to one another, and the piece 40 is oriented in the direction of the corresponding guy at the time of casting. It will be seen that it is especially easy, where appropriate, to replace the piece 40.

It will also be seen that the same piece can be used for fastening the special stabilizing guys 30 for the mast. In fact, these guys are substantially in the same oblique plane as the main sheet of guys.

FIGS. 13 and 14 shown a detailed view of the head 4 of the mast 5.

The guys contained in the two lateral sheets are arranged symmetrically relative to the mid-plane of the structure.

In fact, each guy 3 is continuous between the central span and the end span, the change of direction in line with the mast taking place on a metal saddle 50 making it possible to arrange the guys 3 next to one another.

The special stabilizing guys 30 for the mast are anchored to the top of the latter by known means 51 seated in a recess 52 located underneath the saddle 50. A special saddle could also be provided for these special guys.

FIG. 15*a* and 15*b* and 16 relate to a third embodiment of the invention.

When there is an increase in the number of traffic lanes to be carried (for example, beyond roadways each of a width of 12 m), the size and weight of the prefabricated elements become too large and it is simpler to construct two separate decks 1C and 1D.

Each deck is suspended, on the outside, on a series of oblique guys 3X and, at the centre, on a series of vertical guys 3Y. At regular intervals, articulated links 60 connect the decks in a horizontal direction, in order to balance the horizontal component of the forces in the guys of the two edge sheets. These links allow the decks to execute relative vertical movements, but not approach one another.

According to an alternative embodiment illustrated in FIG. 17, the two decks can be fixed together in line with the central reservation by means of concrete work 61, so as to form a single deck.

The arrangement described by reference to FIGS. 15 and 16, with its four sheets of guys, presents a problem as regards the head of the mast. In fact, placing the guys of the four sheets side by side results in a very large width of this head in the transverse direction. In this case, a different structure of a mast head, illustrated in FIGS. 18 and 19, was developed. Metal pieces 70 and 73, each having the form of a bar with a series of successive holes, are mounted on a framework 74, to form a kind of conical fan diverting upwards and bearing on the top of the mast 5. The guys 3X of an oblique sheet pass successively through a hole in each of the pieces 70 to 73, these holes defining a broken line corresponding to the desired deflection of the guy. The inclination of these pieces relative to the vertical is such that they are contained in the plane of the sheet of the guys 3X.

A second series of pieces 70 to 73 is provided for supporting in the same way guys 3X of the symmetrically oblique sheet. Other similar pieces, of which only one 75 is shown, are arranged in an approximately vertical longitudinal plane for receiving the guys 3Y of the central sheets.

As can be seen, contrary to the arrangement of FIGS. 13 and 14, the guys are supported above one another, and not side by side. The head of the mast thus has greatly reduced transverse dimensions, but it will be seen that the means 51 for fastening the special stabilizing guys 30 are easily accommodated there.

FIGS. 20 and 21 illustrate part of the construction of the deck.

After the pier and the mast have been built, the deck is constructed by successive cantileverings symmetrically in relation to the mast.

To limit the weight of the prefabricated elements 10, the distance between the guys is subdivided into two or three elements 10. A framework 80 anchored at the rear in the already constructed deck carries a hoisting winch 81 which makes it possible to install each of the prefabricated elements and temporarily immobilize it. Because of the relative flexibility of the deck, the exertion of the weight of these prefabricated elements before the following guy 3 is put into eject risks generating considerable temporary stresses. This situation is alleviated by suspending the front part of the assembly girder on the main mast by means of an assembly cable 82 of progressively increasing length.

After the prefabricated elements suspended on the assembly framework 80 have been installed and adjusted, the joints between elements 10 are sealed, the longitudinal assembly prestress is put into effect, and the next permanent guy is put in place, before a new cycle of operations is repeated.

FIG. 21 shows a deck element 10 being raised (arrow 83) in order to be installed.

FIG. 22 shows the situation after this element has been installed. After the joints between elements have been sealed, the prestress has been put into effect and new guys 3A have been put in place, the assembly cable 82 is slackened in order to advance the framework 80 according to the arrow 84.

I claim:

1. Guyed bridge comprising:

at least one deck formed from a series of at least partially prefabricated elements, each element extending over the width of the deck and over some of its length, at least one mast which is carried by a pier and the top of which supports a series of guys supporting the deck, characterized in that the elements form transverse caissons and each element has continuous transversely elongate inner recesses, and a transverse vertical cross-section approximately symmetrical relative to a horizontal plane.

2. Bridge according to claim 1, characterized in that each element is a prefabricated element in one piece, formed from a lower apron and an upper apron carrying the roadway, which are separated by inner voids extending over a large part of the transverse dimension of the element, the aprons being connected by means of longitudinal walls and, if appropriate, partitions and transverse walls and, if appropriate, partitions.

3. Bridge according to claim 1, characterized in that each element comprises a prefabricated part consisting of a lower apron and transverse and longitudinal vertical walls or partitions, horizontal slabs resting on the said walls or partitions, and an upper rough casting which is continuous along the deck, being poured onto the slabs and carrying the roadway.

4. Bridge according to claim 1 characterized in that the pier carrying the mast extends upwards to the deck and supports both at least part of the deck and the mast.

5. Bridge according to claim 4, characterized in that each pier carries that part of the deck which is nearest the longitudinal axial plane of the bridge, and in that part of the deck which is furthest away from the longitudinal axial plane of the bridge is supported by additional guys arranged approximately in a transverse vertical plane and connecting the deck to the top zone of the mast.

6. Bridge according to claim 5, characterized in that at least one of the said additional guys is deflected at the top of the mast and is fastened to the opposite edge of the deck.

7. Deck according to claim 5, comprising two decks places next to one another, characterized in that the two decks are articulated by means of approximately horizontal transverse links, allowing the decks to execute vertical relative movements, but not approach one another.

8. Bridge according to claim 7, characterized in that at least one of the said additional guys is deflected at the top of the mast and is fastened to the opposite edge of the same deck.

9. Bridge according to claim 5, comprising two decks placed next to one another, characterized in that the two decks are connected rigidly to one another in order to react as a single deck.

10. Bridge according to claim 4 characterized in that there are oblique bracing girders connecting the edge of the deck furthest away from the pier to a point of the latter located lower than the deck.

11. Deck according to claim 1 characterized in that the head of a mast is a metal piece which has a saddle-shaped surface in its upper part and on which the deck-supporting guys resting side by side are deflected so as to go to two fastening points located on the deck approximately symmetrically relative to the mast, the middle part of the said metal piece having a cavity which contains the means for the anchorage or deflection of the additional guys.

12. Bridge according to claim 1 characterized in that the head of the mast possesses, for each sheet of cables, a deflecting assembly arranged in the plane of this sheet and comprising at least one piece through which passes a number of deflection passages equal to the number of guys, these passages being superposed on one another, and the means for anchorage or deflection of the additional guys being placed between the deflecting assemblies.

13. Bridge according to claim 1 characterized in that the means for fixing a guy to an element of the deck comprise a plate which is plane as a whole and which bears against the deck by means of a first face and on the second face carries means for retaining the guy, means for preventing the said plate from sliding on the deck, and at least one prestressing cable or anchoring rod directed approximately perpendicularly relative to the place of the said plate, this cable passing through the said plate and being retained by butting against the latter and passing through the deck in order to bear against the opposite side of the deck.

14. Bridge according to claim 13, characterized in that the deck has a plane bearing surface for the plate, this plane surface being parallel to the guy and to the longitudinal axis of the bridge, with a central hollow part, in that the plate carries, on its face in contact with the said bearing surface, a projection which penetrates into the said hollow part and which contains the means for fastening the said prestressing cable, and in that the prestressing cable penetrates into the deck at the bottom of the said hollow part and is fastened to the transversely opposite edge of the deck.

15. Bridge according to claim 13, characterized in that the plate is intended to bear on a horizontal surface of the deck and, on the face opposite the deck, carries mountings for fastening a guy obliquely relative to the horizontal, and in that the prestressing cable or cables or anchoring rods pass downwards through the deck.

16. Process for constructing a bridge according to claim 1 characterized in that a temporary framework fastened to a deck part already constructed and supported by the guys is put in place, this framework advancing in cantilever fashion beyond the said part already constructed and being supported by an assembly cable connecting the top of the mast to that end of the temporary framework furthest away from the part already constructed, and the said temporary framework is used for installing and securing new deck elements, the length of the assembly cable being changed when the temporary framework is shifted.

* * * * *